US010539279B2

(12) United States Patent
Vasquez et al.

(10) Patent No.: US 10,539,279 B2
(45) **Date of Patent: *Jan. 21, 2020**

(54) SYSTEMS FOR DETACHABLY MOUNTING LIGHTING COMPONENTS AND FOR COVERING WIRING

(71) Applicant: Eaton Intelligent Power Limited, Dublin (IE)

(72) Inventors: Charles Vasquez, Peachtree City, GA (US); Jason Quentin Paulsel, Peachtree City, GA (US); Steven Walter Pyshos, Peachtree City, GA (US); Jyoti Kathawate, Smyrna, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/056,169

(22) Filed: Aug. 6, 2018

(65) Prior Publication Data

US 2018/0347768 A1 Dec. 6, 2018

Related U.S. Application Data

(63) Continuation of application No. 15/144,646, filed on May 2, 2016, now Pat. No. 10,041,638.
(Continued)

(51) Int. Cl.
*F21S 8/00* (2006.01)
*F21S 8/02* (2006.01)
(Continued)

(52) U.S. Cl.
CPC ..... *F21S 8/026* (2013.01); *F21K 9/20* (2016.08); *F21V 17/105* (2013.01);
(Continued)

(58) Field of Classification Search
CPC ..... F21W 2131/406; F21V 14/06; F21V 5/04
(Continued)

(56) References Cited

U.S. PATENT DOCUMENTS 8,454,204 B1 6/2013 Chang et al.
10,041,638 B2 * 8/2018 Vasquez ..... F21S 8/026
(Continued)

FOREIGN PATENT DOCUMENTS

CN 102454894 5/2012

OTHER PUBLICATIONS

International Search Report for PCT Patent Application No. PCT/US2016/030464 dated Aug. 25, 2016.
(Continued)

*Primary Examiner* — Ahshik Kim
(74) *Attorney, Agent, or Firm* — King & Spalding LLP

(57) ABSTRACT

A system can comprise tabs and notches or a twist-and-lock mount for detachably mounting components adjacent a light emitting diode that is utilized for illumination, for example in a luminaire. Representative mounted components can include protective covers and optics for managing light emitted by the light emitting diode. The tabs and notches can be located rear of an aperture in a recessed lighting fixture or in a cover of a luminaire, for example. That cover, or another cover that may not utilize a releasable mount, can extend circumferentially about a periphery of a light emitting diode to cover and protect wiring for the light emitting diode and to hide the wiring from view by people occupying an illuminated space.

19 Claims, 14 Drawing Sheets

Related U.S. Application Data

(60) Provisional application No. 62/244,053, filed on Oct. 20, 2015, provisional application No. 62/155,607, filed on May 1, 2015.

(51) Int. Cl.

| | |
|---|---|
| ***F21V 17/10*** | (2006.01) |
| ***F21V 29/77*** | (2015.01) |
| ***F21K 9/20*** | (2016.01) |
| *F21V 5/04* | (2006.01) |
| *F21Y 115/10* | (2016.01) |

(52) U.S. Cl.
CPC ..... *F21V 29/773* (2015.01); *F21V 5/04* (2013.01); *F21Y 2115/10* (2016.08)

(58) Field of Classification Search
USPC ..... 362/268
See application file for complete search history.

(56) References Cited

U.S. PATENT DOCUMENTS

| | | | |
|---|---|---|---|
| 2007/0183154 | A1 | 8/2007 | Robson |
| 2013/0051034 | A1 | 2/2013 | Hashimoto |
| 2013/0294084 | A1 | 11/2013 | Kathawate et al. |
| 2014/0146545 | A1 | 6/2014 | Chung et al. |
| 2016/0040863 | A1 | 2/2016 | Beck |

OTHER PUBLICATIONS

Ledil, ProductDatasheet, C12691, Lena Series, May 21, 2014.
Ideal, Installation Instructions, Chip-Lok Holder, Mar. 2012.
TE Connectivity, Z50 2213194, Jan. 2014.
Halo, H4 LED Downlight Series 2$^{nd}$ Generation, Specification Sheet, Jul. 9, 2014.
Iris, P3LED E3SLOT, Specification Sheet, Cooper Lighting, Aug. 5, 2013.

* cited by examiner

SYSTEMS FOR DETACHABLY MOUNTING LIGHTING COMPONENTS AND FOR COVERING WIRING

CROSS REFERENCE TO RELATED APPLICATIONS

This application is a continuation of and claims priority to U.S. patent application Ser. No. 15/144,646 filed May 2, 2016 and titled "Systems for Detachably Mounting Lighting Components and For Covering Wiring," which claims priority to U.S. Provisional Patent Application No. 62/155,607 filed May 1, 2015 and titled "A Light Emitting Diode Wire Cover for an Interchangeable Optic Mounting," and which claims priority to U.S. Provisional Patent Application No. 62/244,053 filed Oct. 20, 2015 and titled "Luminaire With Changeable Elements". The entire contents of the foregoing applications are hereby incorporated herein by reference.

TECHNICAL FIELD

Embodiments of the technology relate generally to lighting systems and more specifically to a luminaire that may incorporate interchangeable optics or magnetically attached trim and to a light emitting diode wire cover for an interchangeable optic mounting.

BACKGROUND

For illumination applications, light emitting diodes (LEDs) offer substantial potential benefit associated with their energy efficiency, light quality, and compact size. However, to realize the full potential benefits offered by light emitting diodes, new technologies are needed.

For instance, there are needs in the art for fixtures that offer improved flexibility and that facilitate interchangeable elements or user customization. Need exists for technology to provide conveniently interchangeable light sources. Need further exists for technology to provide conveniently interchangeable trim.

As another example of need, when light emitting diodes are mounted on a circuit board using a conventional approach, lead wires connected to the circuit board can be visible and thereby distractive or perceived as unsightly. Accordingly, there is a need for a cover to hide lead wires connected to light emitting diode light sources. Additionally, it would be beneficial if a cover could protect the components attached to the light emitting diode and provide a mounting point for other components that may be attached to the light emitting diode light source.

A capability addressing one or more such needs, or some other related deficiency in the art, would support improved illumination systems and more widespread utilization of light emitting diodes in lighting applications.

SUMMARY

In an aspect of the disclosure, a luminaire comprises a system of tabs and notches for changing out a component that is disposed adjacent a light emitting diode. The component may be a light module that comprises an optic for managing light emitted by the light emitting diode. The component may alternatively comprise a dust cover for protecting the light emitting diode during installation, for example.

In another aspect of the disclosure, a wiring cover can extend circumferentially about a periphery of a light emitting diode. The wiring cover can cover wiring for the light emitting diode to protect the wiring and further to obscure the wiring from view. The wiring cover may also comprise a system of tabs or notches for attaching protective or light-management components to the wiring cover in front of the light emitting diode.

The foregoing discussion is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

BRIEF DESCRIPTION OF THE FIGURES

Reference will now be made below to the accompanying drawings, which can be briefly described as follows.

Figure 1A:
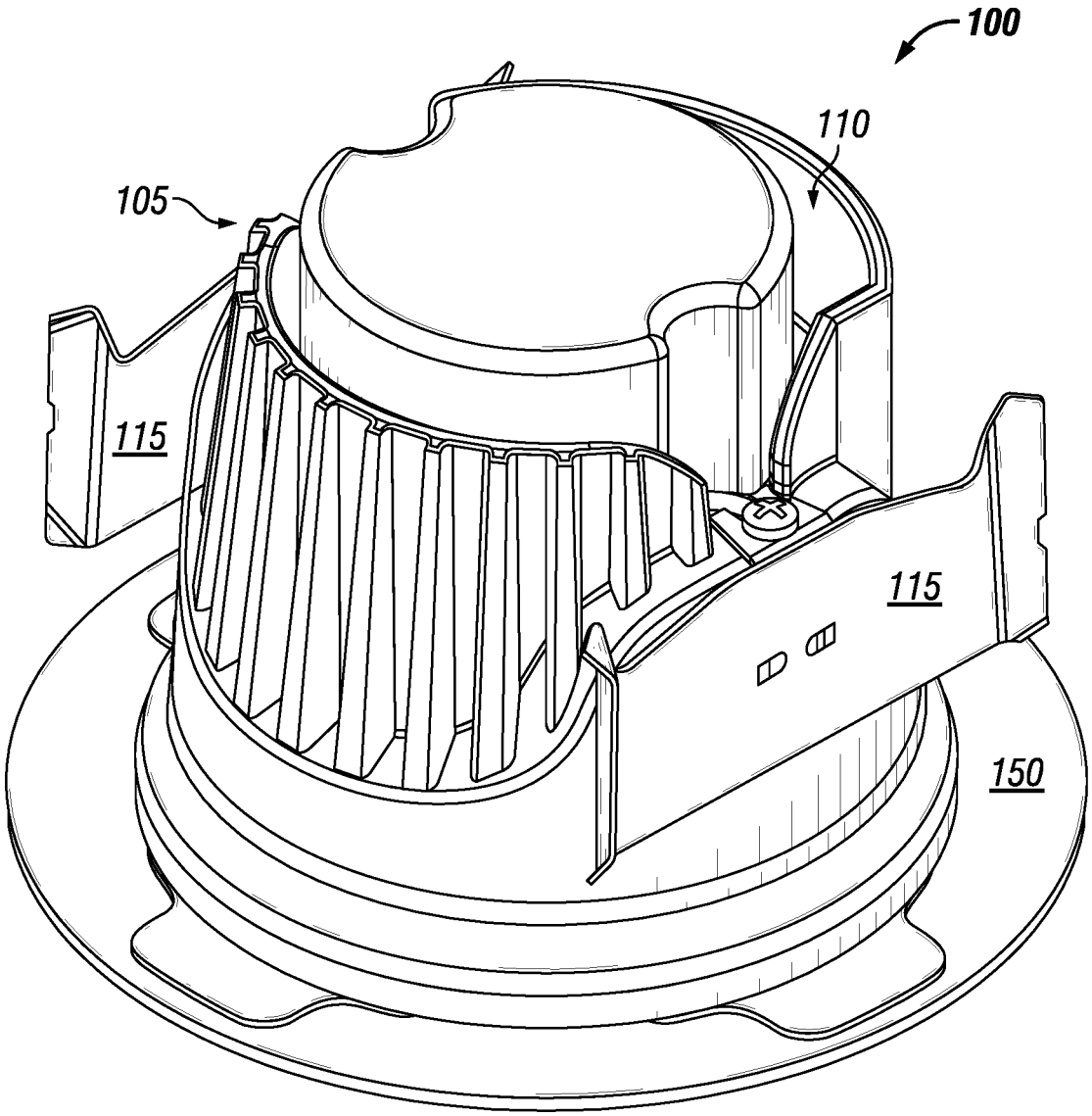
FIGS. 1A, 1B, 1C, 1D, 1E, and 1F (collectively FIG. 1) illustrate a recessed luminaire in accordance with an example embodiment of the disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DESCRIPTION OF EXAMPLE EMBODIMENTS

In accordance with some embodiments of the disclosure, a small aperture light emitting diode retrofit module or kit can comprise user interchangeable beam-forming optics and/or trim that may be magnetically attached to a lighting fixture. The trim may be square or circular, for example.

In accordance with some embodiments of the disclosure, a retrofit light emitting diode module can be compatible with and installed in various luminaires or lighting fixtures that are already installed in the field. Such fixtures or luminaires may be four-inch in some embodiments, for example.

In accordance with some embodiments of the disclosure, a family of readily interchangeable optics and a family of trim shapes and finishes can be readily installed, positioned, and replaced in luminaires, for example in a retrofit scenario or in a new installation.

In accordance with some embodiments of the disclosure, a light source or light emitting diode module for a lighting fixture or luminaire can comprise a retrofit module. The light source or light emitting diode module can comprise user interchangeable optics in some embodiments. The light source or light emitting diode module can be attached to the fixture via a twist-and-lock mount. The twist-and-lock mounting system can be keyed or otherwise polarized to facilitate angular alignment, for example for applications involving asymmetric beam spread optics. In various embodiments, the light source or light emitting diode module can comprise, provide, or otherwise support multiple beam angles; converging beam optics; or an optional media holder, for example for one-piece media utilization.

In accordance with some embodiments of the disclosure, a lighting fixture or luminaire can comprise magnetically attached trim options. Square, rectangular, or circular trim (or trim having some other appropriate geometric form) can be magnetically attached to a lighting fixture adjacent an aperture that emits light into a space to illuminate the space. In various embodiments, the trim can offer multiple painting and plating options and may utilize steel or iron materials or some other paramagnetic, magnetic, or magnetically active material to facilitate magnetic attachment. The trim can be open or can comprise a lens, filter, or other optic, optical element, or optical system, for example.

In accordance with some embodiments, a light emitting diode module can utilize stainless steel brackets to stop the module from recessing too far as well as for retaining magnets in the housing. Magnet brackets can support a wide variety of commercial housing diameters, for example. In some embodiments, the brackets may be formed of material that is not attracted by an ordinary magnet or not magnetically active.

In accordance with some embodiments disclosed herein, a luminaire may comprise a light emitting diode wire cover. Wiring may be hidden in the wire cover from view to a person who is in an area in which the luminaire is mounted to provide illumination. The light emitting diode wire cover may have an accompanying, removable dust cover for protecting a light emitting diode during installation.

Some representative embodiments will be further described hereinafter with example reference to the accompanying drawings that describe representative embodiments of the present technology. The technology may, however, be embodied in many different forms and should not be construed as limited to the embodiments set forth herein; rather, these embodiments are provided so that this disclosure will be thorough and complete, and will fully convey the scope of the technology to those appropriately skilled in the art.

FIGS. 1A, 1B, 1C, 1D, 1E, and 1F illustrate a recessed luminaire in accordance with some example embodiments of the disclosure. FIGS. 2A, 2B, 2C, 2D, 2E, 2F, and 2G illustrate a light module that is compatible with the luminaire 100 of FIG. 1 in accordance with some example embodiments of the disclosure. FIGS. 3, 4, 5, 6, 7, 8, 9, and 10 describe a luminaire comprising a wire cover that may have an associated dust cover in accordance with some example embodiments of the disclosure.

FIG. 1 will now be discussed in further detail. FIG. 1A illustrates a perspective view of the luminaire 100, from a perspective that is lateral and slightly above the luminaire 100, with the luminaire 100 outfitted with circular trim 150. FIG. 1B illustrates a perspective view of the luminaire 100, from a perspective that is lateral and slightly below the luminaire 100, where the luminaire 100 is outfitted with circular trim 150. FIG. 1C illustrates a cutaway perspective view of the luminaire 100. FIG. 1D illustrates a cross sectional view of the luminaire 100. FIG. 1E illustrates a perspective view of the light-emitting end of the luminaire 100, where the trim 150 has been removed. FIG. 1F illustrates a perspective view of the luminaire 100, from below, where the luminaire 100 is outfitted with rectangular trim 151 that may replace the circular trim 150 illustrated in FIGS. 1A and 1B.

Figure 1B:
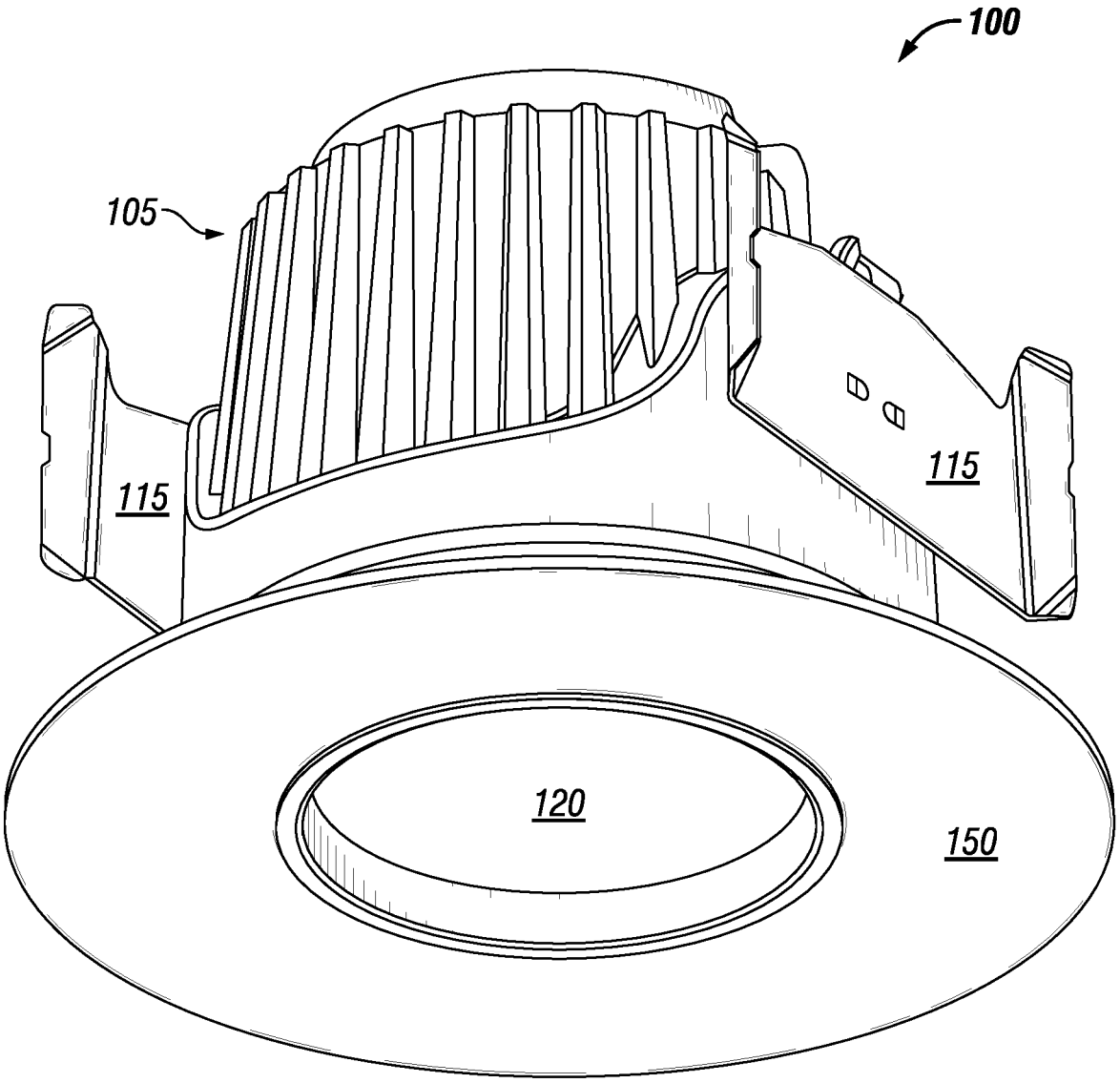
Figure 1C:
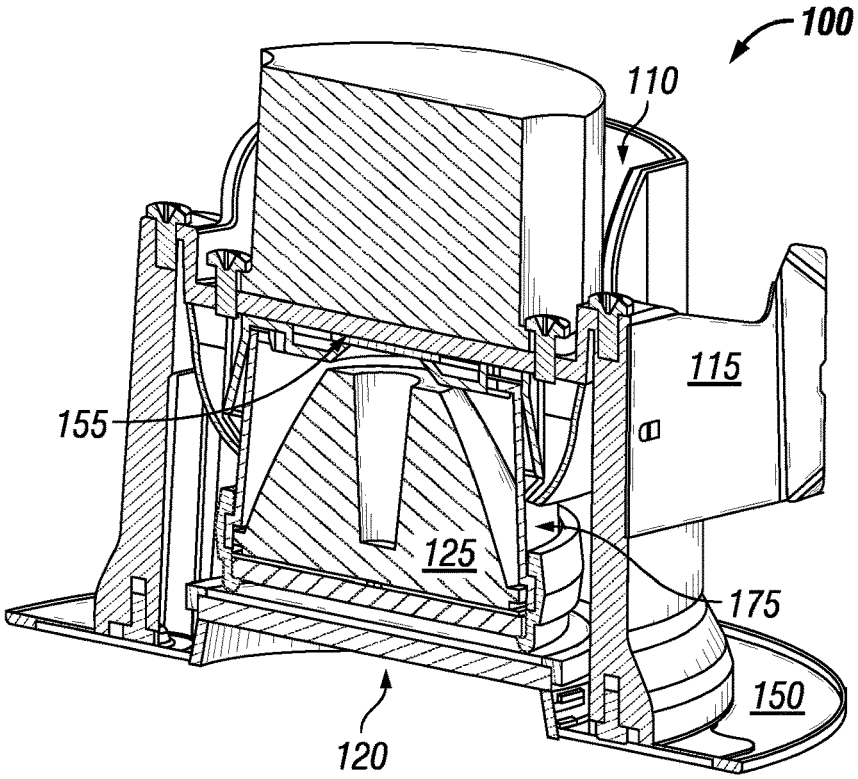
Figure 1D:
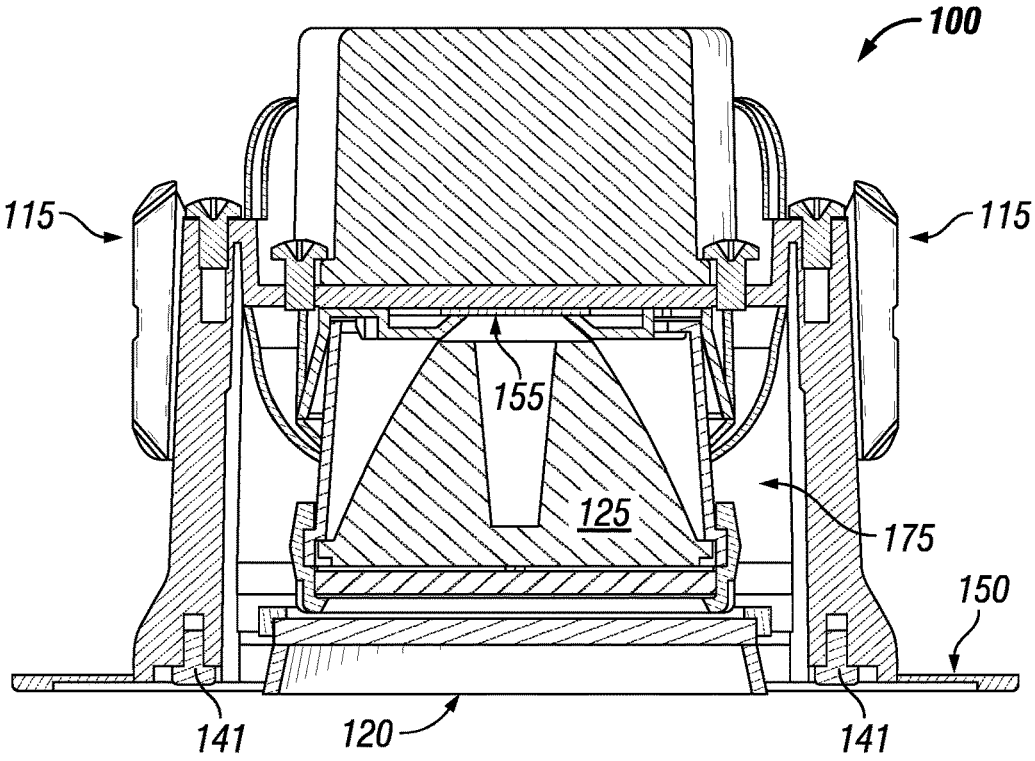
Figure 1E:
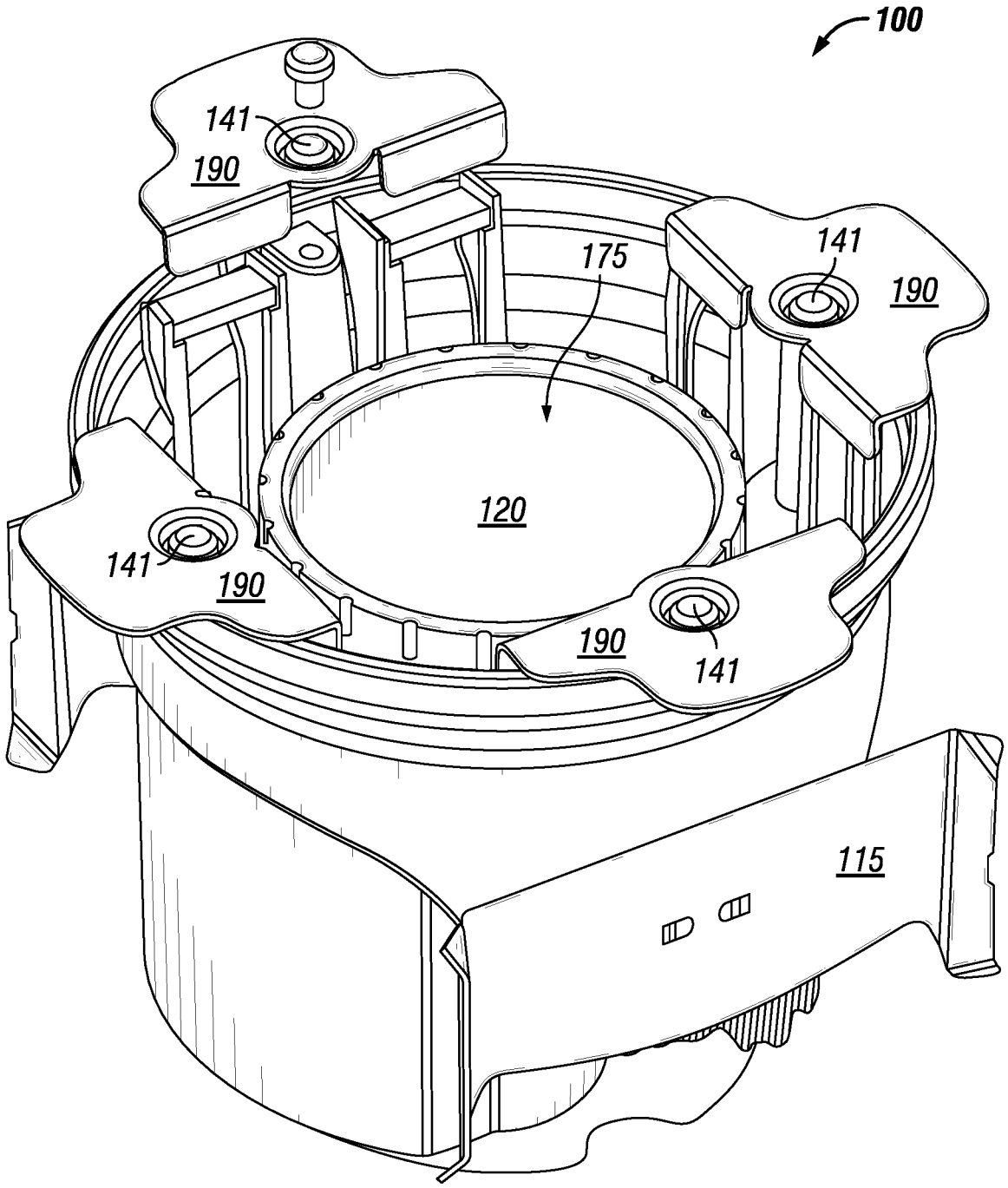
Figure 1F:
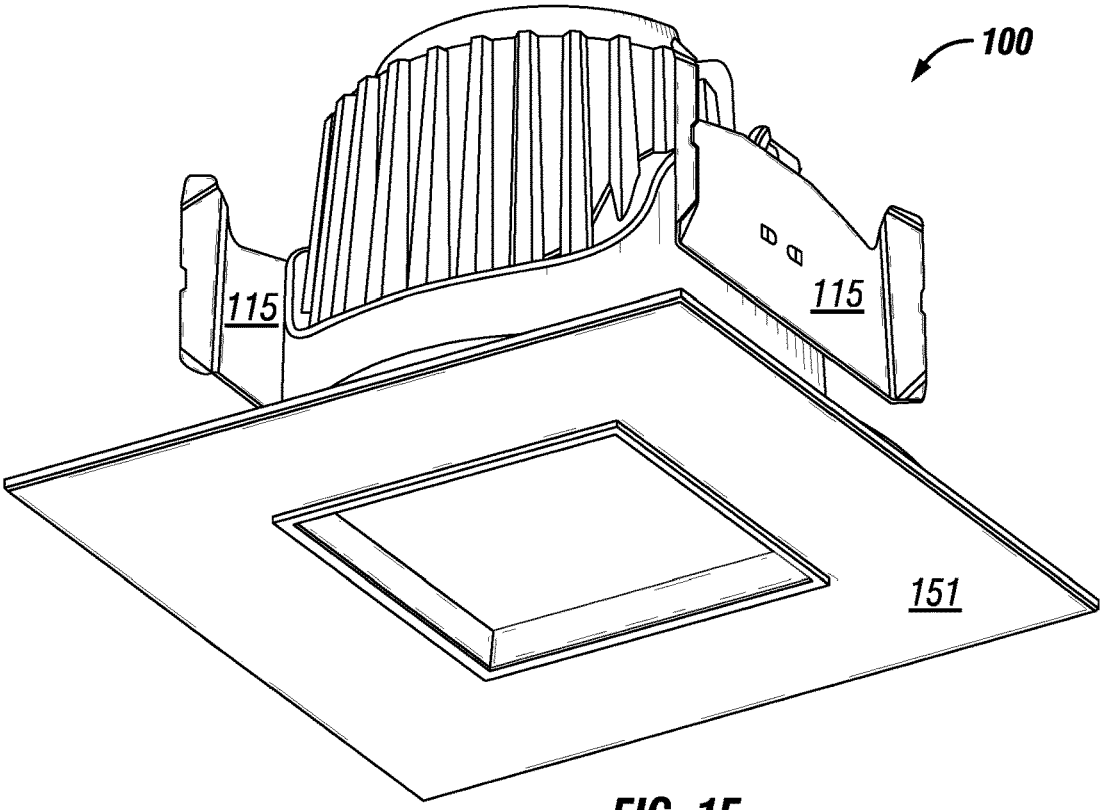

In operation, the luminaire 100 emits light from an aperture 120, which has associated circular trim 150 as illustrated in FIG. 1B, or rectangular trim 151 as illustrated in FIG. 1F. The trim 150, 151 facilitates mounting at a flat surface, for example to accommodate recessed installation in a ceiling or other appropriate structure. When deployed in a recessed ceiling application, the trim 150, 151 extends around a hole in the ceiling in which the luminaire 100 is mounted. Brackets 115 facilitate mounting the luminaire 100 to beams or other structures or supports above the ceiling.

In the illustrated embodiment, the frame of the luminaire 100 comprises four magnets 141 that are located around the aperture 120 of the luminaire 100. The magnets 141 may be held in place using glue, crimping, screws, press fit, or other appropriate attachment facilities, for example. As illustrated, the magnets 141 are located in positioning members 190 that may be formed of a nonmagnetic material, for example stainless steel, fiberglass, or plastic. The positioning members 190 can aid in aligning the trim 150, 151 to the luminaire 100 during trim installation. The positioning members 190 can further provide a mechanical stop for the trim 150, 151.

In some embodiments, the magnets 141 are located inside the aperture 120 rather than outside of the aperture 120 as illustrated. In some embodiments, the magnets 141 are located both inside and outside the aperture 120.

The trim 150, 151 is typically formed of a material that is magnetically active, for example steel or iron, so that the magnets 141 attract and retain the trim 150, 151. While as illustrated, the magnets 141 are attached to the body of the luminaire 100, in some other embodiments, the magnets 141 are integrated in the trim 150. In such an embodiment, the trim may be composed of a plastic, aluminum, or other non-magnetic material.

As illustrated in FIG. 1A, the upper portion of the luminaire 100 comprises heat sink fins 105 for dissipating heat generated during operation of the light emitting diode 155. The luminaire frame encloses an electrical supply and provides thermal management for operating the light emitting diode 155 and dissipates heat via the heat sink fins 105. The luminaire 100 further comprises a pocket or opening 110, opposite the heat sink fins 105, for wiring connections.

The luminaire 100 comprises a light module 175 that is located in an aperture 120 of the luminaire 100 and that emits light out of the luminaire 100 through a central opening in the trim 150, 151. As will be further discussed below with reference to FIG. 2, the light module 175 comprises an optic 125 that controls light emitted by the light emitting diode 155.

FIG. 2, which illustrates example elements of or for the luminaire 100 illustrated by FIG. 1, will now be discussed in further detail. FIG. 2A illustrates a perspective view of the light module 175 and associated mount 215. FIG. 2B illustrates an end view of the light module 175 and associated mount 215. FIG. 2C illustrates a cross sectional view of the light module 175 and associated mount 215, where the cross section is taken along the C-C line shown in FIG. 2B. FIG. 2D illustrates a perspective view of a cutaway view of the light module 175 and associated mount 215. In the view of FIG. 2D, the light module 175 is positioned adjacent the light emitting diode 155, which is typically permanently mounted to the frame of the luminaire 100 at a lower portion of the aperture 120, for example mounted to the rear side of the mount 215, which is fastened to the frame. (However, in some embodiments, the light emitting diode 215 is permanently mounted to the light module 175.) FIG. 2E illustrates an assembly view of the light module 175 and associated mount 215 (without showing the light emitting diode 155). FIG. 2F illustrates a front view of the mount 215 for the light module 175. That is, FIG. 2F illustrates the end of the mount 215 that receives the light module 175 as discussed below. FIG. 2G illustrates a front view of a housing 230 of the light module 175.

In some embodiments, the light module 175 comprises the light emitting diode 155. The light emitting diode 155 can be mounted directly to the light module 175, so that removal of the light module 175 from the luminaire 100 removes the light emitting diode 155 from the luminaire 100. Similarly, the light module 175 and the light emitting diode 155 can be inserted into the luminaire aperture 120 as a unit.

In some embodiments, the light emitting diode 155 is mounted to the luminaire frame essentially permanently and/or separately from the light module 175. Thus, insertion of the light module into the luminaire aperture 120 can position the light module optic to receive light from the light emitting diode 155. More specifically, the light emitting diode 155 can be mounted to the backside of the mount 215 as illustrated in FIG. 2D.

The light module 175 attaches to the frame of the luminaire 100 via the mount 215 (see FIGS. 2D, 2E, and 2F) via an associated connection that may be characterized as twist-and-lock or as a system of tabs and notches. The mount 215 comprises fastener holes 261, which may be located on 120 degrees of angular separation around the mount periphery (or at some other appropriate locations). Screws or other fasteners extend through the holes 261 to fix the mount 215 to the frame of the luminaire 100 at the rear or back of the aperture 120.

The light module 175 comprises the housing 230 into which an optic 125 is attached. The optic 125 manipulates light emitted by the light emitting diode 155, for example to provide a desirable pattern of illumination. In various example embodiments, the optic 125 can comprise one or more lenses or one or more reflectors, for example. In some embodiments (for example as illustrated), the optic 125 may be symmetric about a central axis of the optic 125. In some embodiments, the optic 125 provides an illumination pattern that is symmetrical and aligned with an axis of the light emitting diode 155 or an axis of the luminaire 100. In some other embodiments, the illumination pattern may be asymmetric with respect to the axis of the light emitting diode 155 and may diverge from that axis. In such an embodiment, the optic 125 may be asymmetric about a central axis of the optic 125.

Figure 2A:
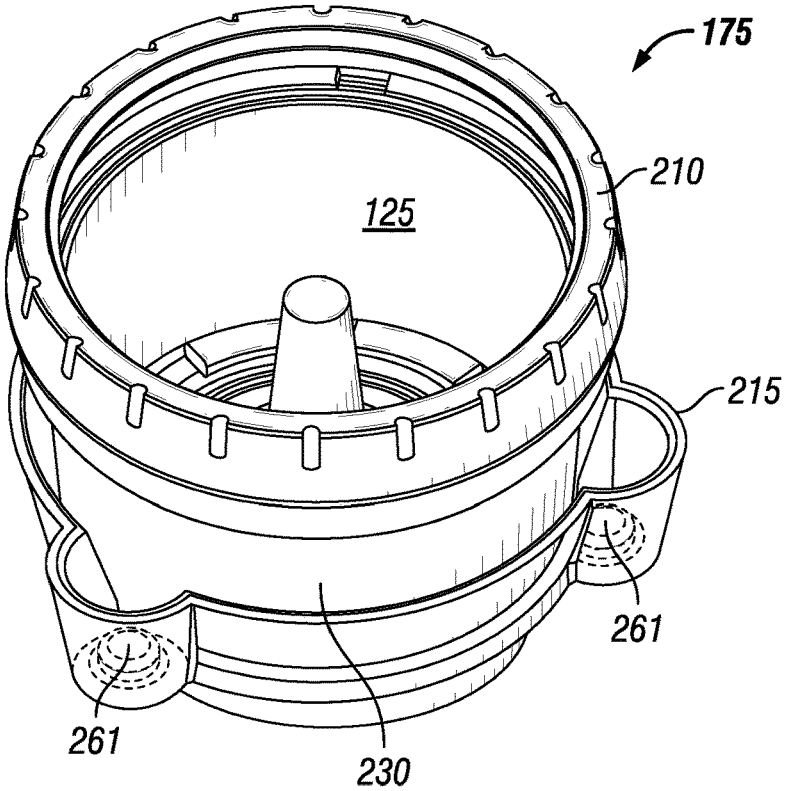
FIGS. 2A, 2B, 2C, 2D, 2E, 2F, and 2G (collectively FIG. 2) illustrate a light module and associated mount that are compatible with the luminaire of FIG. 1 in accordance with an example embodiment of the disclosure.
Figure 2B:
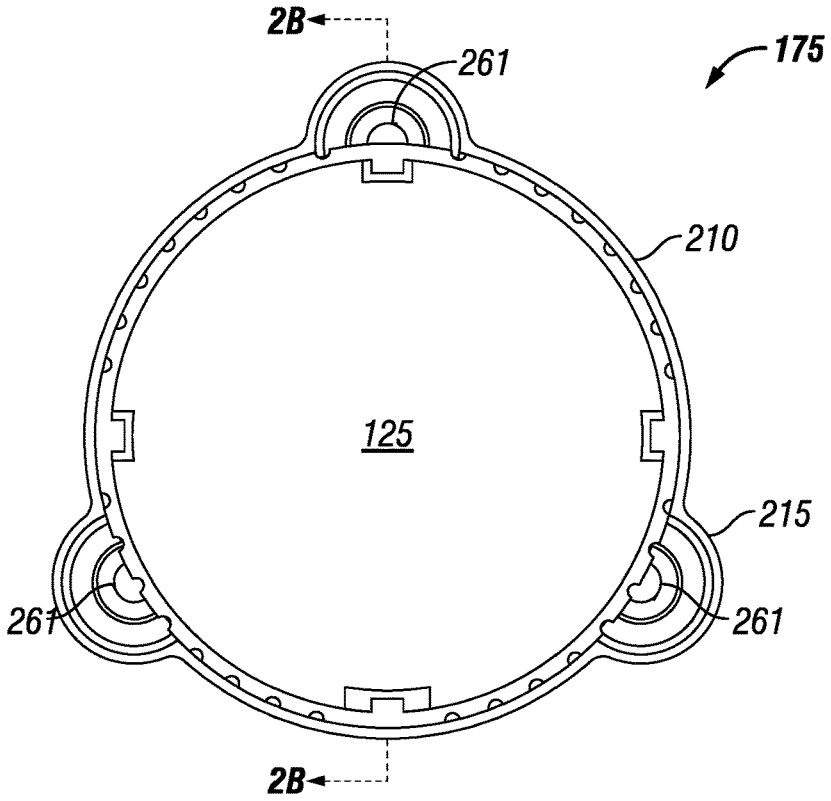
Figure 2C:
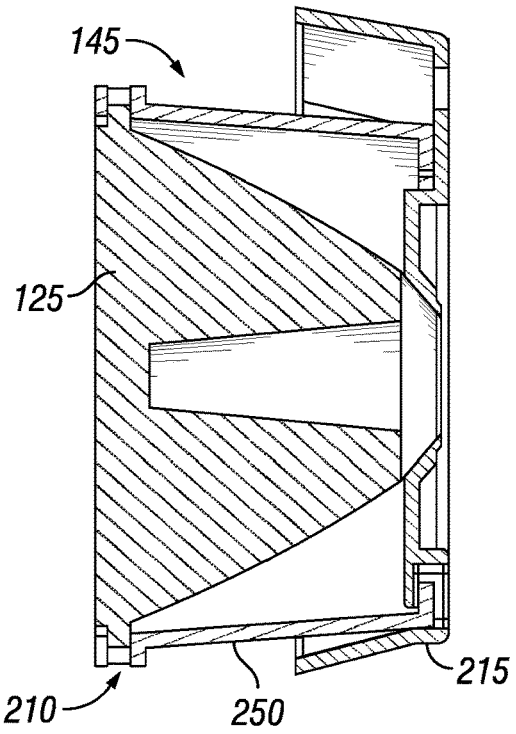
Figure 2D:
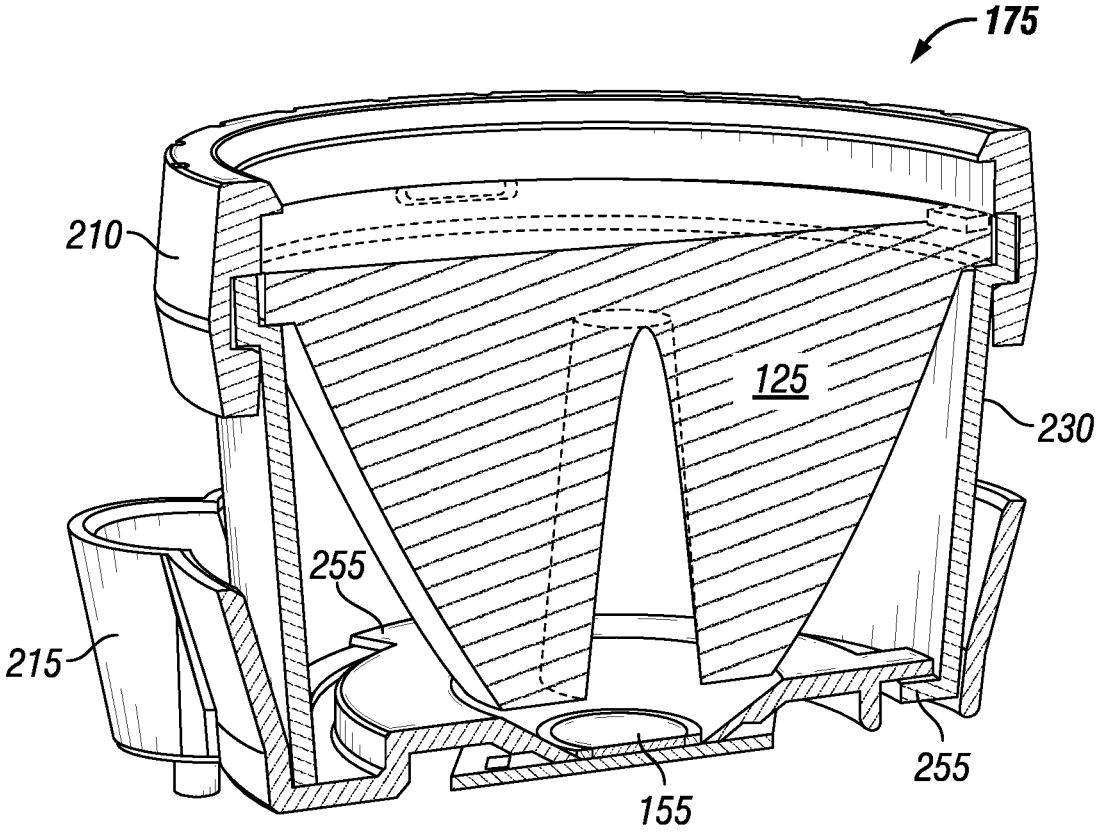
Figure 2E:
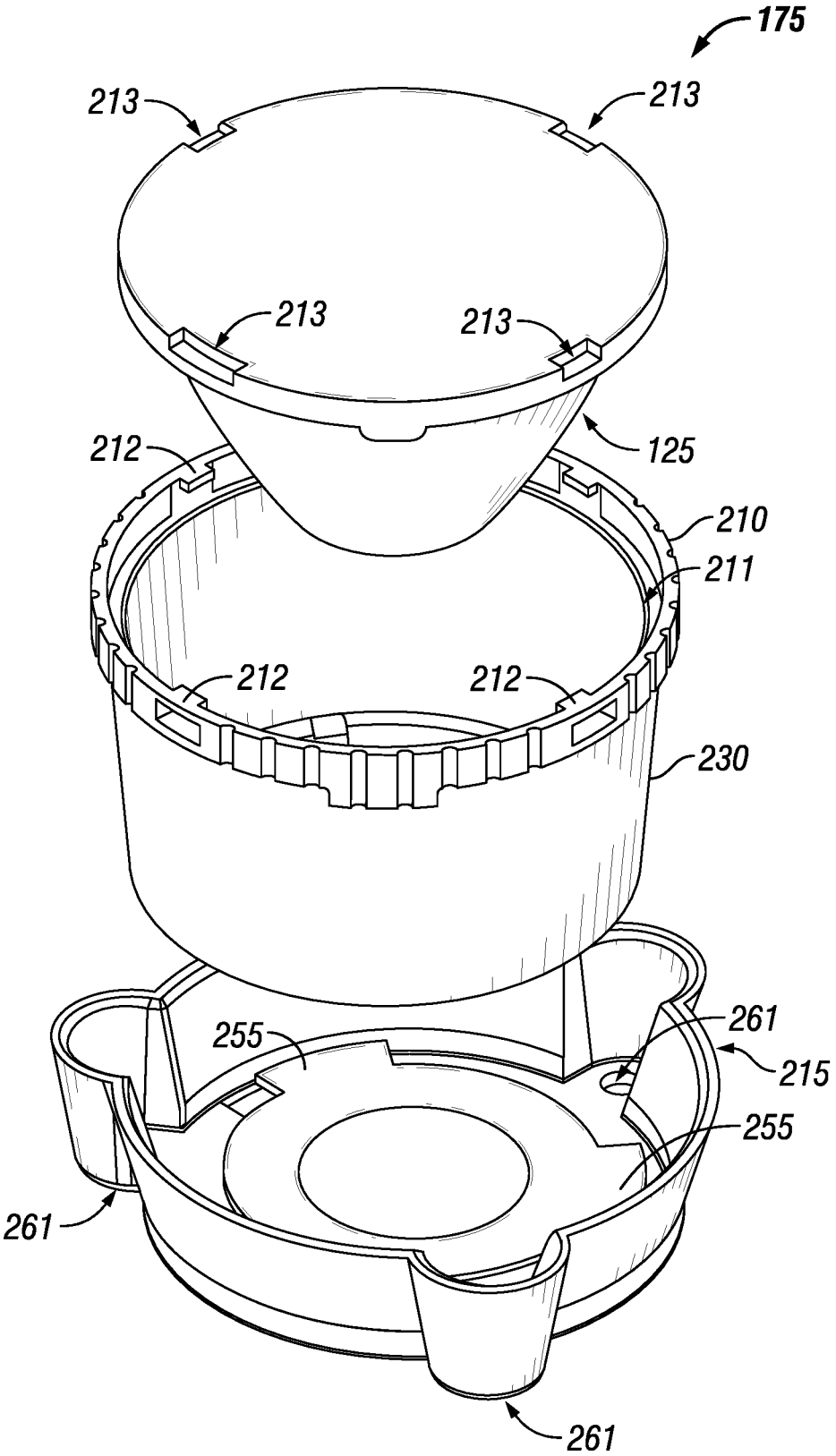

As can be seen in FIG. 2A, a grip 210 extends around the housing 230 to facilitate user handling and rotation during insertion into or removal from the aperture 120 of the luminaire 100. As can be seen in FIG. 2E, the housing 230 comprises a tube in which the optic 125 is housed. The internal surface of the tube can comprise a shoulder 211 upon which the outer rim of the optic 230 seats. Tabs 212 in the housing 230 can engage with corresponding indentations 213 in the optic to retain the optic 125 in the housing 230 against the shoulder 211. Diffusers, filters, or other optical elements can be attached to the light module 175 at or under the grip 210, for example.

Figure 2F:
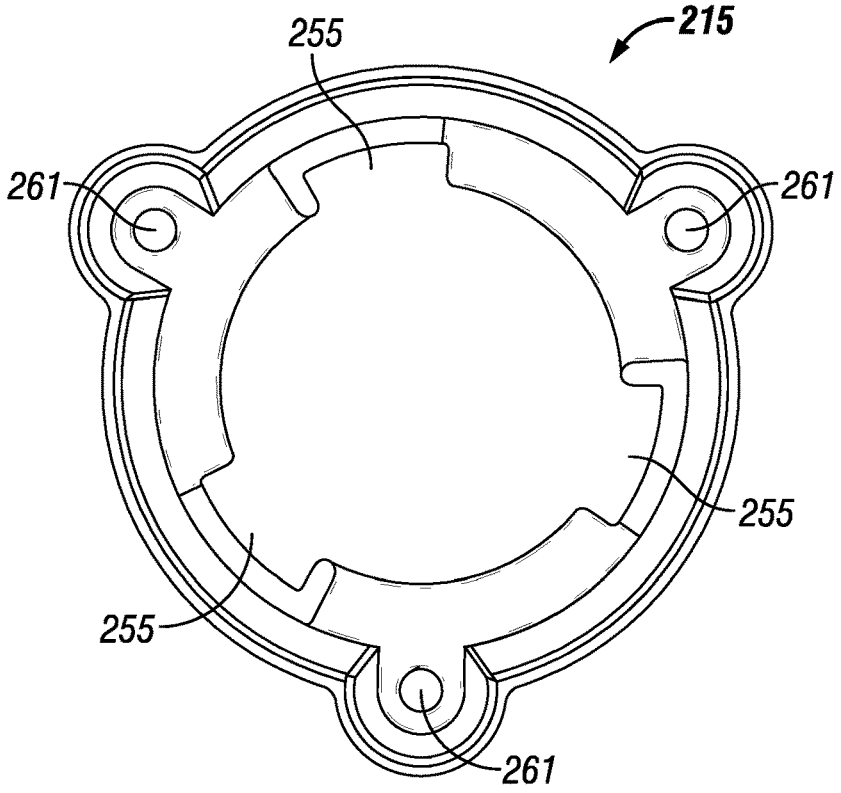
Figure 2G:
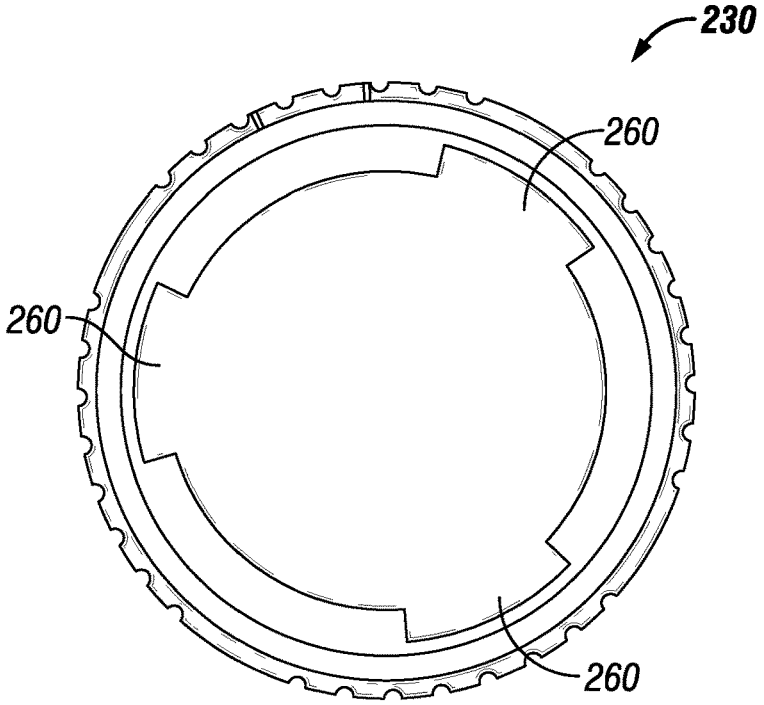

As best seen in FIGS. 2D, 2E, and 2F, the mount 215 comprises three tabs 255 that project radially outward from a raised area at the center of the mount 215. The back of the housing 230 comprises three notches 260 (see FIG. 2G) that correspond to the three tabs 255. The tabs 255 and notches 260 form a twist-and-lock connection system through which a user can readily swap out light modules 175 according to preference. As will be discussed in further detail below with reference to FIG. 7, inter alia, the twist-and-lock connection system can be compatible with a dust cover for covering and protecting the light emitting diode 155 when the light module 175 is not mounted.

In operation, the user inserts the light module 175 into the aperture 120 of the luminaire 100 and aligns the tabs 255 to the notches 260 of the mount 215. As best seen in FIG. 2C, the side of the mount 175 that faces the aperture 120 is flared outward in a manner that can facilitate field assembly. This tapered opening provides a lead-in that helps the user position the light module 175 into the mount 215 and can guide or facilitate notch-to-tab alignment. The user can thus complete the location and insertion without having to visibly see the mount 215 at the bottom of the aperture 120. The geometry of the mount 215, including its outer wall, can further block any light leakage between the mount and the optic 125.

To continue the assembly, the user advances the light module 175 into the aperture 120, so that the tabs 255 locate in the notches 260. The user then twists the light module 175 so that the tabs 255 rotate behind the notches 260 and thus out of alignment, resulting in capture and retention.

In some embodiments, the tabs 255 and notches 260 are keyed or polarized to limit user insertion to a single rotational alignment. For example, one of the tabs 255 may be wider than the other tabs 255, and one of the notches 260 may be correspondingly wider than the other notches 260. In this manner, the light module 175 is restricted to mating with the mount 215 in a single rotational orientation. The resulting rotational alignment can be useful for setting light output to a particular direction, for example when the optic 125 emits a pattern of light that is skewed or offset relative to a mechanical axis of the light module 175 or to an optical axis of the light emitting diode 155 as discussed above.

FIGS. 3, 4, 5, 6, 7, 8, 9, and 10 will now be discussed in further detail. The features and technologies illustrated in FIGS. 3-10 and discussed below may be integrated into or otherwise combined with the embodiments illustrated in FIGS. 1 and 2. Accordingly, the luminaire 100 can comprise or be utilized with appropriate technologies, features, elements, or components illustrated in any of FIGS. 3, 4, 5, 6, 7, 8, 9, and 10 or discussed below, without limitation. Similarly, the technologies illustrated in FIGS. 1 and 2 and discussed above can be applied to the embodiments illustrated in FIGS. 3-10 and discussed above. One of ordinary skill in the art having benefit of the disclosure and teaching presented herein can readily implement such applications.

Figure 3:
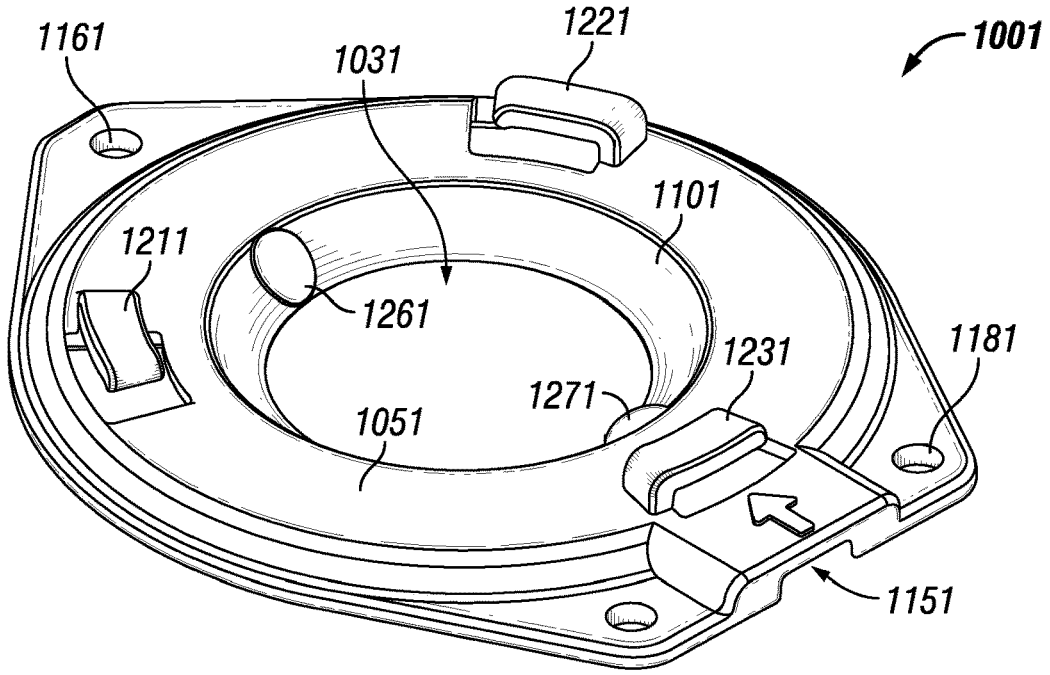
FIG. 3 illustrates a perspective view of a wire cover in accordance with an example embodiment of the present disclosure.
Figure 4:
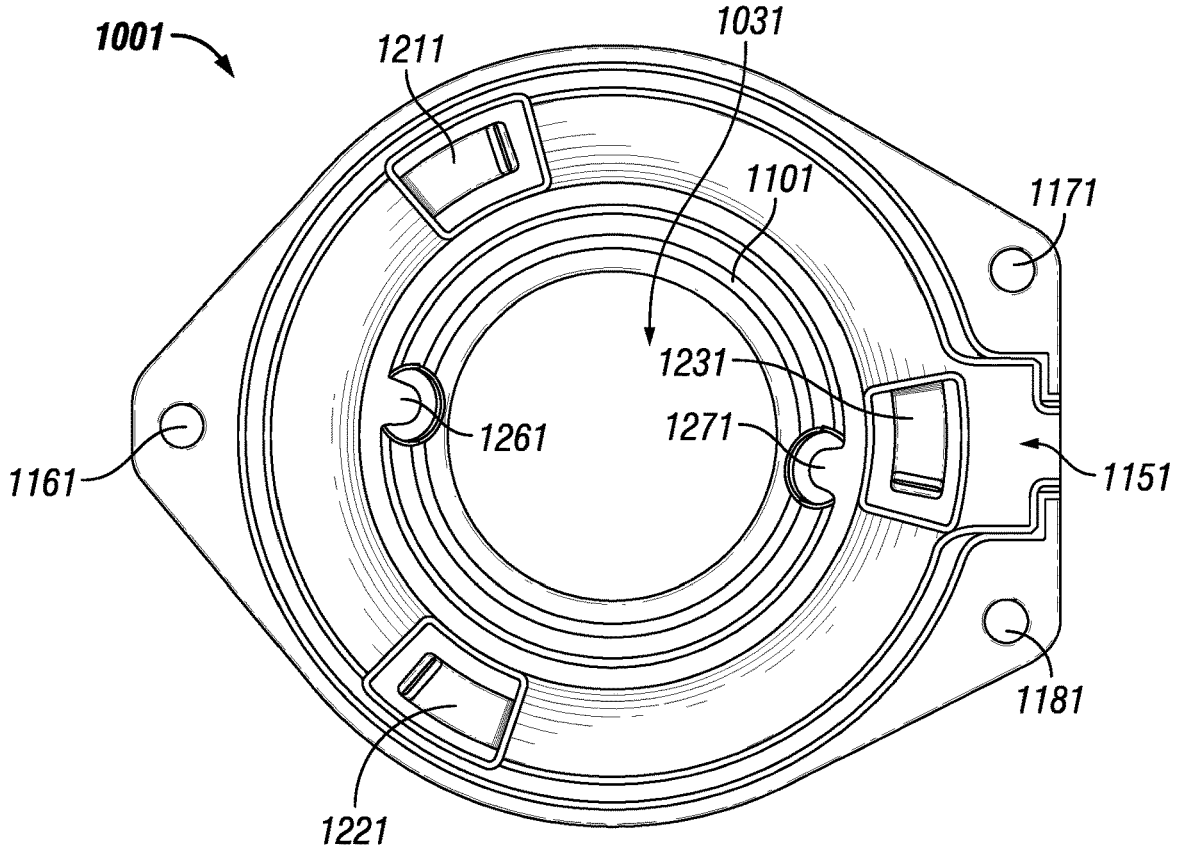
FIG. 4 illustrates a bottom view of the wire cover of FIG. 3 in accordance with an example embodiment of the present disclosure.
Figure 5:
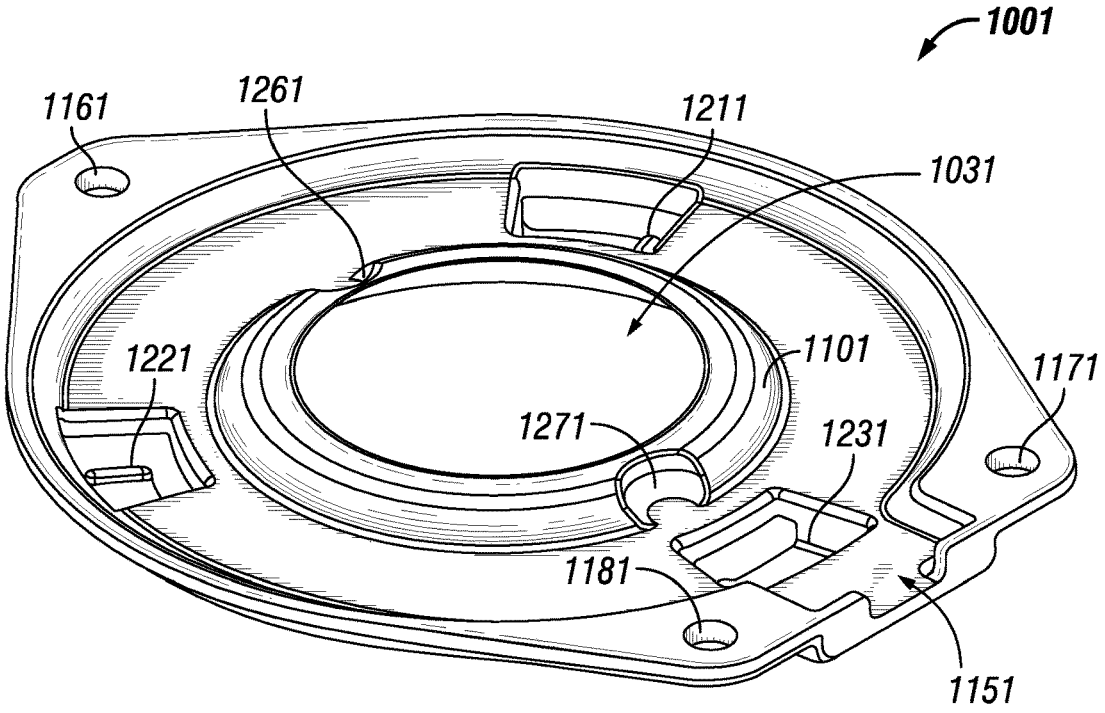
FIG. 5 illustrates a bottom perspective view of the wire cover of FIG. 3 in accordance with an example embodiment of the present disclosure.
Figure 6:
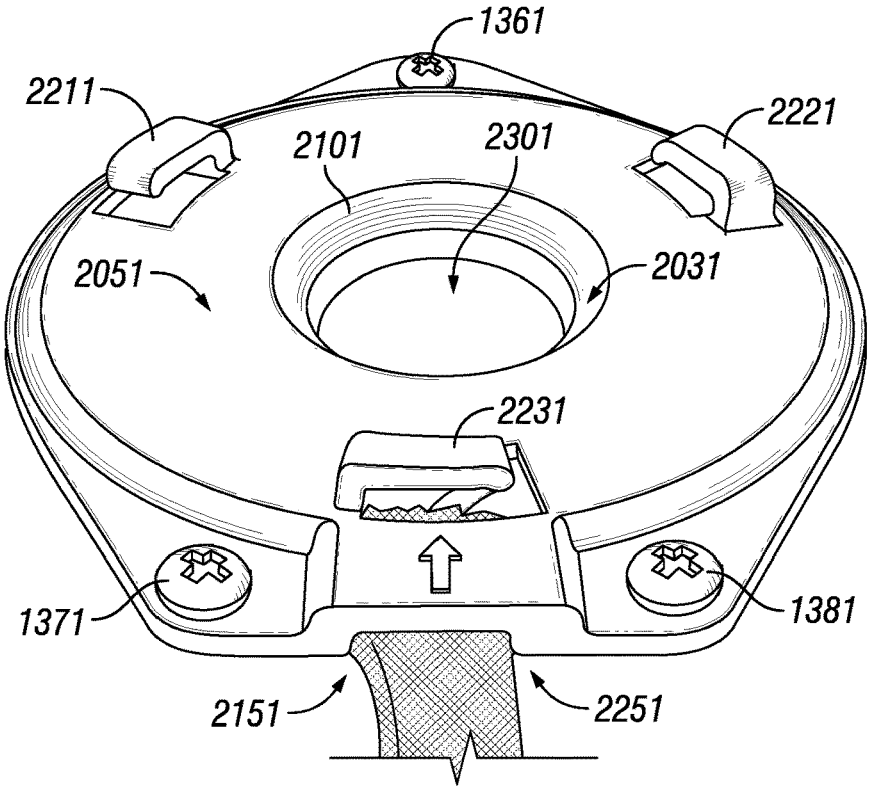
FIG. 6 illustrates an installed wire cover in accordance with an example embodiment of the present disclosure.

FIG. 3 illustrates a perspective view of a wire cover 1001 in accordance with the example embodiments described herein. In an example embodiment, a luminaire can comprise the wire cover 1001. FIGS. 4 and 5 illustrate bottom and bottom perspective views, respectively, of the example wire cover 1001. A wire cover, such as the illustrated example wire cover 1001, can be made from molded thermoplastic or any other appropriate material. As illustrated in FIG. 3, the example wire cover 1001 can comprise a light emitting diode aperture 1031 in which a light emitting diode is disposed, for example as illustrated in FIG. 6.

Although some example embodiments herein refer to a light emitting diode disposed in the light emitting diode aperture 1031, a variety of light emitting diode technologies and embodiments can be used with the wire cover 1001 including single light emitting diodes, arrays of discrete light emitting diodes, and chip-on-board light emitting diodes without limitation. The example wire cover 1001 includes a light funnel 1101, which is an angled or tapered surface that assists in directing light out of the luminaire or in an intended direction or to provide a desired light distribution. The surface of the light funnel 1101 can be white in color and be highly reflective so as to optimize the amount of light directed out of the luminaire. In some embodiments, the reflectivity is diffuse; while in some embodiments, the reflectivity is specular.

The example wire cover 1001 also comprises protrusions 1261 and 1271 along the surface of the light funnel 1101. The protrusions 1261 and 1271 accommodate fasteners located below the wire cover 1001 which fasten the light emitting diode to the luminaire. As seen in other example embodiments described herein, the protrusions 1261 and 1271 are not required in certain wire covers having other dimensions or configurations.

The illustrated example wire cover 1001 also comprises fastening points 1161, 1171, and 1181. In the example embodiment shown in FIG. 3, the fastening points 1161, 1171, and 1181 are apertures through which a fastener can pass and can be secured to a portion of the luminaire on which the wire cover 1001 sits. In alternate embodiments, the fastening points can take other forms including clips or tabs that secure the wire cover 1001. Fastening points 1171 and 1181 may be disposed on either side of wiring aperture 1151. A wiring aperture 1151 permits lead wires to pass under the wire cover 1001 and connect to the light emitting diode as illustrated in FIG. 6. Fastening points 1171 and 1181 are positioned on either side of the wiring aperture 1151 in order to provide strain relief for the wires passing through the wiring aperture 1151 as illustrated in FIG. 6.

The example wire cover 1001 also comprises a top surface 1051 that covers wires located below the cover. One benefit of the wire cover 1001 is that it protects the wiring located beneath the wire cover. The top surface 1051 comprises mounting tabs 1211, 1221, and 1231. The mounting tabs 1211, 1221, and 1231 facilitate securing of a reflector or other device to the wire cover 1001. In other embodiments of the wire cover 1001, there may be fewer or more mounting tabs and the mounting tabs can have a different geometry or shape, for example.

Referring now to FIG. 6, another example embodiment of a wire cover 2001 is illustrated. Many of the features shown in example wire cover 1001 are the same as, correspond to, or are similar to example wire cover 1001. Those same, corresponding, or similar features have reference numbers with the same last three digits and the description of those features will not be repeated. The example wire cover 2001 in FIG. 6 is shown installed in an example luminaire. FIG. 6 shows a light emitting diode 2301 disposed in light emitting diode aperture 2031. FIG. 6 also shows fasteners 1361, 1371, and 1381 disposed at the three fastening points of the wire cover 2001. The example wire cover 2001 shown as installed in FIG. 6 also has lead wires wrapped in a protective sleeve 2251 and passing through the wiring aperture 2151. The fasteners 1371 and 1381 on either side of the wiring aperture 2151 assist in relieving potential strain on the wiring sleeve 2251.

Figure 7:
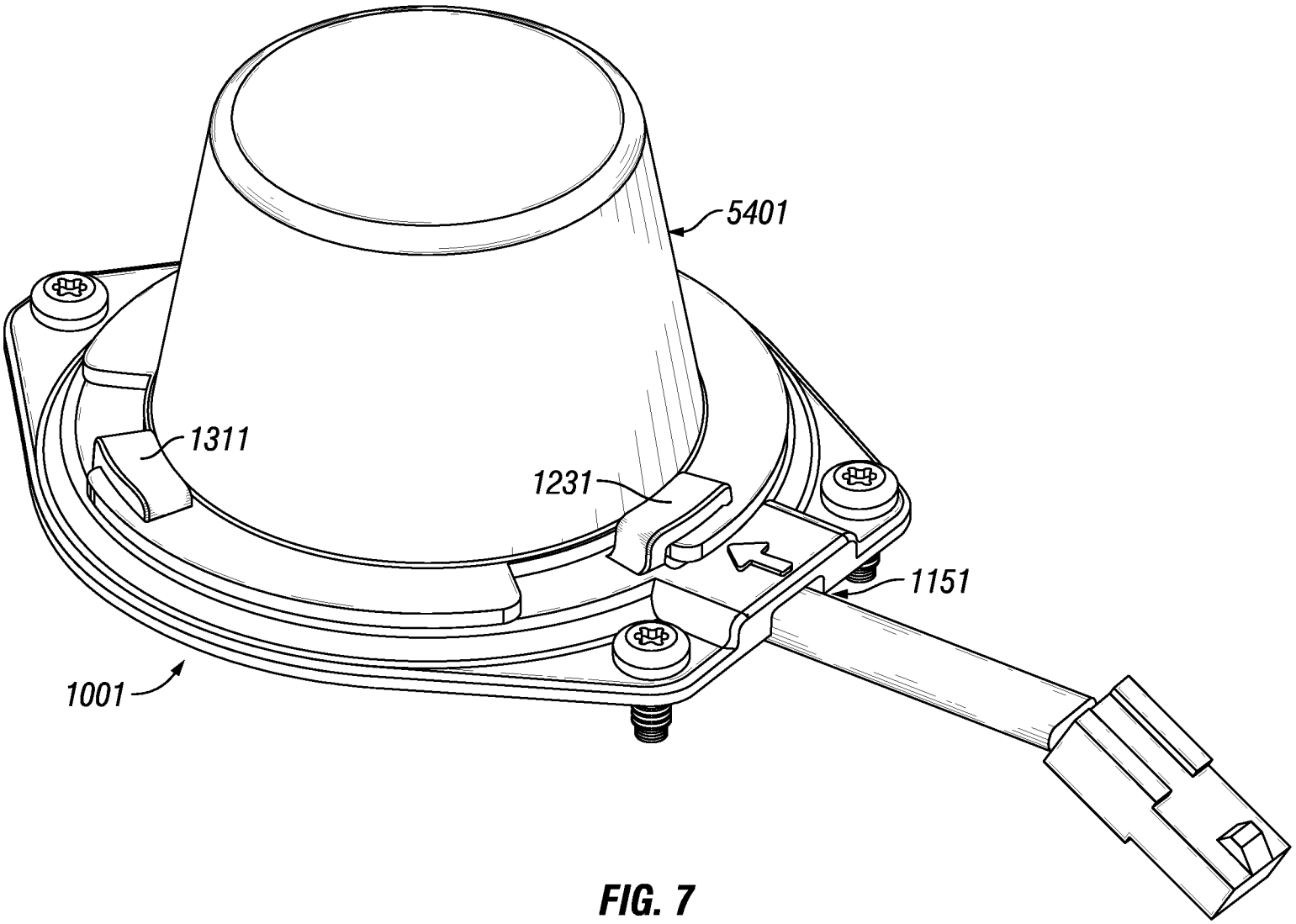
FIG. 7 illustrates an installed wire cover with a dust cover in accordance with an example embodiment of the present disclosure.

FIG. 7 illustrates the example wire cover 1001 with a dust cover 5401 mounted on the wire cover 1001. The dust cover 5401 is designed with and comprises flanges along its bottom edge that fit under or into the mounting tabs 1211, 1221, and 1231 of the wire cover 1001. The dust cover 5401 protects the light emitting diode disposed within the wire cover 1001 during shipping and installation of the luminaire. Once the luminaire is installed and ready for use, the dust cover 5401 can be removed by twisting the dust cover flanges out from under the mounting tabs 1211, 1221, and 1231.

Figure 8:
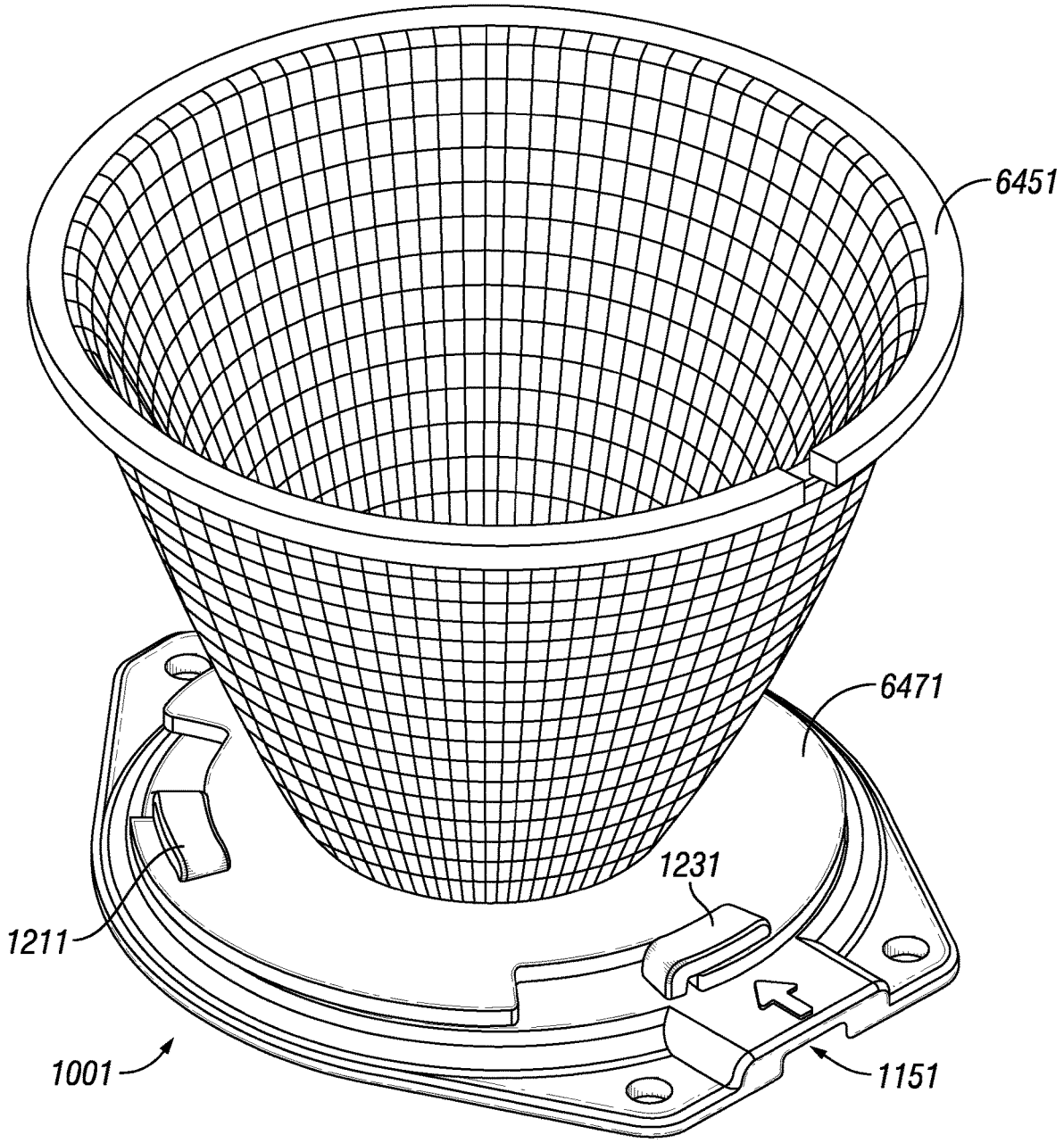
FIG. 8 illustrates a wire cover with a reflector in accordance with an example embodiment of the present disclosure.

Referring to FIG. 8, the example wire cover 1001 is shown with a reflector 6451 mounted on the wire cover 1001. In the illustrated embodiment, the reflector 6451 comprises an integral reflector base 6471. In alternate embodiments, the reflector base 6471 may not be integral with the reflector 6451 and may be a separate component that is attached to the reflector. The reflector base 6471 is designed with flanges that slide under the mounting tabs 1211, 1221, and 1231 to secure the reflector 6451 in the proper position. In an example embodiment, the dust cover 5401 illustrated in FIG. 7 can be removed and replaced with the reflector 6451. One benefit of the example wire covers described herein is that the mounting tabs can accommodate a variety of reflectors, light modules, optics, and assorted optical devices and covers that can be changed or replaced allowing for different beams or light distributions.

Figure 9:
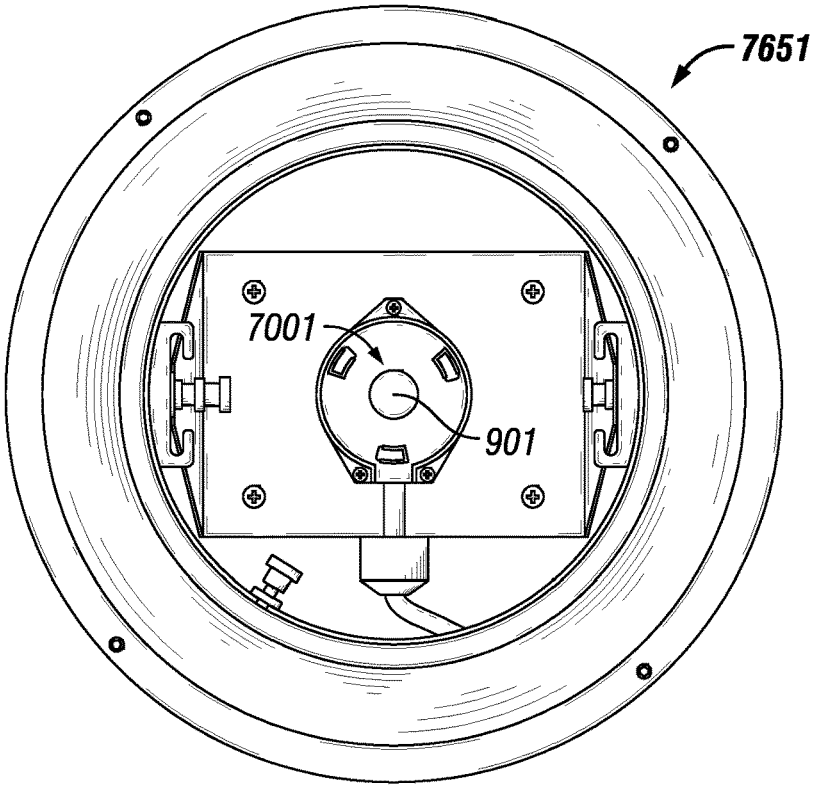
FIG. 9 illustrates a wire cover installed in a light fixture in accordance with an example embodiment of the present disclosure.
Figure 10:
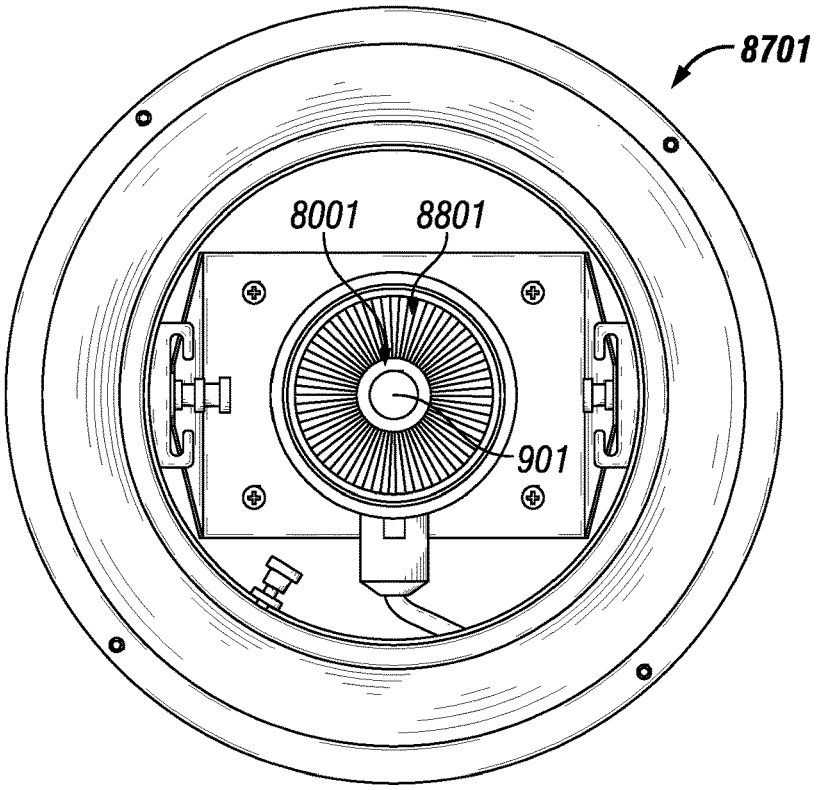
FIG. 10 illustrates a wire cover installed in a light fixture with a reflector in accordance with an example embodiment of the present disclosure.

FIGS. 9 and 10 illustrate example wire covers installed in luminaires. Referring to FIG. 9, the wire cover 7001 is shown installed in a luminaire housing 7651 with a light emitting diode 901 visible through the light emitting diode aperture of the wire cover 7001. The wire cover 7001 protects and hides the lead wires connected to the light emitting diode 901. In FIG. 10, the wire cover 8001 is again installed in a luminaire housing 8701 with a light emitting diode 901 visible through the light emitting diode aperture of the wire cover 8001. However, in FIG. 10, a reflector 8801 has been mounted to the wire cover 8001 using the mounting tabs (not visible in FIG. 10) on the wire cover 8001.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A luminaire comprising:

a light source comprising a light emitting diode;

a housing in which an optic is removably coupled, the housing configured for positioning the optic in front of the light emitting diode;

a frame that defines an inner cavity and that comprises an opening for emitting light from the light source to an area to be illuminated, a mounting structure that is disposed in the inner cavity and removably coupled to a rear end of the frame that is opposite to the opening for emitting light, wherein the mounting structure comprises a plurality of tabs that project radially outward from a raised area at the center of the mounting structure, wherein the housing is removably coupled to the frame via the plurality of tabs of the mounting structure such that when installed, the housing is disposed in the inner cavity defined by the frame.

2. The luminaire of claim 1, wherein the optic is substantially symmetric about a central axis of the optic.

3. The luminaire of claim 1, further comprising a trim that is magnetically attached to the frame at the opening, wherein the frame comprises positioning tabs that are disposed adjacent to the opening, and wherein each positioning tab of the positioning tabs comprises a magnet.

4. The luminaire of claim 1, wherein the plurality of tabs and the raised area are disposed at a back end of the mounting structure that is opposite to another opening at a front end of the mounting structure, and wherein the mounting structure comprises a side wall that defines a cavity that extends and tapers from the front end to the back end.

5. The luminaire of claim 1, wherein the housing comprises a plurality of notches disposed at a rear of the housing for engaging the plurality of tabs of the mounting structure.

6. The luminaire of claim 1, wherein the luminaire comprises a recessed lighting fixture configured to provide overhead lighting.

7. A luminaire comprising:

a light source module comprising a light emitting diode, an optic, and a housing that positions the optic in front of the light emitting diode, wherein the housing comprises a side wall that defines an inner cavity, wherein an internal surface of the side wall of the housing comprises a shoulder that is disposed offset from a bottom edge of the housing and one or more inner tabs that extend radially and inwardly from the internal surface of the side wall, and wherein the optic is disposed in the inner cavity of the housing and is coupled to the housing such that the optic engages the shoulder of the housing and the one or more inner tabs of the housing;

a frame that defines a frame inner cavity, a system of tabs and notches that detachably couple the housing and the optic of the light source module to the frame such that when installed, the housing and the optic are disposed in the frame inner cavity; and a trim that is magnetically attached to the frame.

8. The luminaire of claim 7, wherein a mount comprises the tabs and the housing comprises the notches, and wherein the mount is fastened to the frame and comprises an opening that is flared to guide the tabs and notches into alignment with one another.

9. The luminaire of claim 7, wherein the housing comprises the tabs and a mount comprises the notches, wherein the mount is fastened to the frame and comprises an opening that is flared to guide the tabs and notches into alignment with one another.

10. The luminaire of claim 7, wherein the light emitting diode is mounted to the frame behind the housing, wherein the frame comprises a heat sink portion that defines an inner pocket for routing electrical wires associated with the luminaire in a concealed manner, wherein the housing comprises an optic holder or an optic holder assembly, and wherein the light emitting diode is mounted to the frame so that when the system of tabs and notches holds the housing and the optic, the optic is aligned to receive light from the light emitting diode and direct the received light out of the luminaire.

11. The luminaire of claim 7, further comprising a wire cover that covers and protects the light source, via engaging a portion of the system of tabs and notches that is mounted to the frame.

12. A luminaire comprising:

a housing;

a light source attached to the housing; and a wire cover disposed around the light source, wherein the wire cover is mounted to the housing such that a central opening defined by the wire cover is disposed adjacent and around the light source, and wherein the wire cover comprises a wiring aperture that is formed at a perimeter of the wire cover to pass wires therethrough for connecting to the light source, wherein the wires are concealed by a top surface of the wire cover.

13. The luminaire of claim 12, wherein the central opening is defined by a light funnel formed in the wire cover, wherein the light funnel comprises an angled surface for directing light emitted from the light source out of the luminaire.

14. The luminaire of claim 13, wherein the light funnel comprises notches formed therein to receive fasteners that secure the light source to the luminaire.

15. The luminaire of claim 12, wherein the wire cover comprises fastening points disposed on either side of the wiring aperture.

16. The luminaire of claim 12, wherein the wire cover comprises mounting tabs.

17. The luminaire of claim 16, wherein the mounting tabs can accommodate a dust cover.

18. The luminaire of claim 16, wherein the mounting tabs can accommodate a reflector.

19. The luminaire of claim 16, wherein the light source comprises a light emitting diode, and wherein the luminaire further comprises an opaque dust cover that engages with the mounting tabs to cover and protect the light source during installation of the luminaire and that is removable following installation of the luminaire.

* * * * *